US006058524A

United States Patent [19]

Deveer

[11] Patent Number: 6,058,524

[45] Date of Patent: May 9, 2000

[54] ANTISEPTIC BRUSH USED IN COMBINATION, AFTER USE OF A BIDET, WITH AN ANTI-SEPTIC SKIN CLEANSER

[76] Inventor: William B Deveer, 7604 Main St., #110, New Gardens, N.Y. 11367

[21] Appl. No.: 09/033,384

[22] Filed: Mar. 2, 1998

[51] Int. Cl.[7] ..... A47K 7/00

[52] U.S. Cl. ..... 4/661; 4/443

[58] Field of Search ..... 4/661, 420.1, 420.2, 4/420.3, 420.4, 420.5, 443, 444, 445, 446, 447, 448; 15/159.1, 161, 160, 114, 21.1

[56] References Cited

U.S. PATENT DOCUMENTS

| | | | |
|---|---|---|---|
| 3,770,200 | 11/1973 | Bauer et al. | 239/102 |
| 4,724,563 | 2/1988 | Fry et al. | 15/28 |
| 5,628,083 | 5/1997 | Hayes | 15/244.3 |

*Primary Examiner*—David J. Walczak

[57] ABSTRACT

The process of the use of a bidet and an antiseptic brush in combination with an anti-viral, anti-bacterial, skin cleanser, leads to an anti-sepsis of the anal area of the buttocks. This process could reduce risk of serious disease such as meningitis, hepatitis and many other diseases that may lead to loss of life.

2 Claims, 3 Drawing Sheets

ANTISEPTIC BRUSH USED IN COMBINATION, AFTER USE OF A BIDET, WITH AN ANTI-SEPTIC SKIN CLEANSER

BACKGROUND

CROSS REFERENCE TO RELATED INVENTIONS

The antiseptic brush is used after the use of a bidet; please refer to the bidet U.S. Pat. No. 5,722,097 issued on Mar. 3, 1998 to the same inventor; William B. Deveer. The bidet is used the clean the buttocks of fecal matter after defecating with a stream of of water sprayed onto the dirty buttocks. The antiseptic brush is used after the use of the bidet to dis-infect the buttocks in conjunction with use of a sudsing, anti-bacterial, anti-viral, cleansing soap applied onto the antiseptic brush.

BACKGROUND

1. Field of Invention

This invention relates to the process of dis-infection of the buttocks with a combination of the use of a bidet and an antiseptic brush (operated with application of an anti-viral, anti-bacterial skin cleanser onto the antiseptic brush.) This combination is required to achieve the state of anti-sepsis in the anal area of the buttocks. Anti-sepsis is a term used to describe the elimination of bacteria and virus'.

BACKGROUND

2. Discussion of Prior Art

There are no other prior art inventions in the field of dis-infection of the buttocks known to this inventor. There have been other brushes to scrub the back of the body but not for disinfection of the buttocks. Dis-infection of the buttocks requires the area to be cleansed free of solid fecal matter and then to use a brush designed to cleanse the buttocks with use of an anti-viral, anti-bacterial sudsing soap. Prior art inventions were designed the clean the back of the upper body with use of the ordinary soap. They were not designed to clean the buttocks; in the area of the anus. This area has many bacteria and virus' which could lead to serious disease. Prior art inventions were not used in a combination that enabled cleansing and then dis-infection to reach a state of anti-sepsis in the anal area of the buttocks. Anti-sepsis is achieved after cleansing solid fecal matter from the anal area of the buttocks with a forced stream of water and then applying an anti-viral, anti-bacterial skin cleanser to the area with use of an anti-septic brush. (Anti-sepsis is the elimination of bacteria and virus'.) Prior Art inventions did not lead to anti-sepsis of the anal area of the buttocks.

OBJECTS AND ADVANTAGES

The advantages of the combination of the use of a bidet and the antiseptic brush are dis-infection of the buttocks which could reduce the risk of serious disease such as meningitis, hepatitis, and many other serious diseases that could lead to loss of life.

The combination of use of the bidet and antiseptic brush enables the dis-infection of an area of the buttocks where there is excessive perspiration and a higher body temperature; such an area enables bacteria and virus' to germinate and lead to serious infections.

The dis-infection is achieved with a combination of processes: to cleanse the area with a forced stream of water; such as the stream of water from the bidet (the use of the bidet is more effective than use of toilet paper in removing solid fecal matter.) The bidet cleansing prepares the area for anti-sepsis (anti-sepsis is the elimination of bacteria and virus.) Anti-sepsis requires the area to be clean of solid fecal matter. The use of the antiseptic brush with an anti-viral, anti-bacterial, skin cleanser (after the the use of the bidet,) enables anti-sepsis of the anal area of the buttocks. The anti-septic skin cleanser described above are special sudsing cleansers used for pre-operative dis-infection of the skin by surgeons. It is also used for dis-infection of the hands by medical personnel. This process of the use of a bidet with an antiseptic brush in combination with an anti-septic skin cleanser also provides for a clean and refreshing feeling after use. It would also reduce risk of soiling underclothing.

DESCRIPTION OF THE DRAWING FIGURES

FIG. 1 this page shows the bidet in U.S. Pat. No. 5,722,097 issued on Mar. 3, 1998 to this inventor; William B. Deveer.

LIST OF REFERENCE NUMERALS

Ref. No. Parts of the Drawings

20 the nozzle of the bidet in U.S. Pat. No. 5,722,097 issued on Mar. 3, 1998 to this inventor; William B. Deveer

21 the flexible tubing that is connected to the water source in the bidet U.S. Pat. No. 5,722,097 issued on Mar. 3, 1998 to this inventor; William B. Deveer

Figure 1:
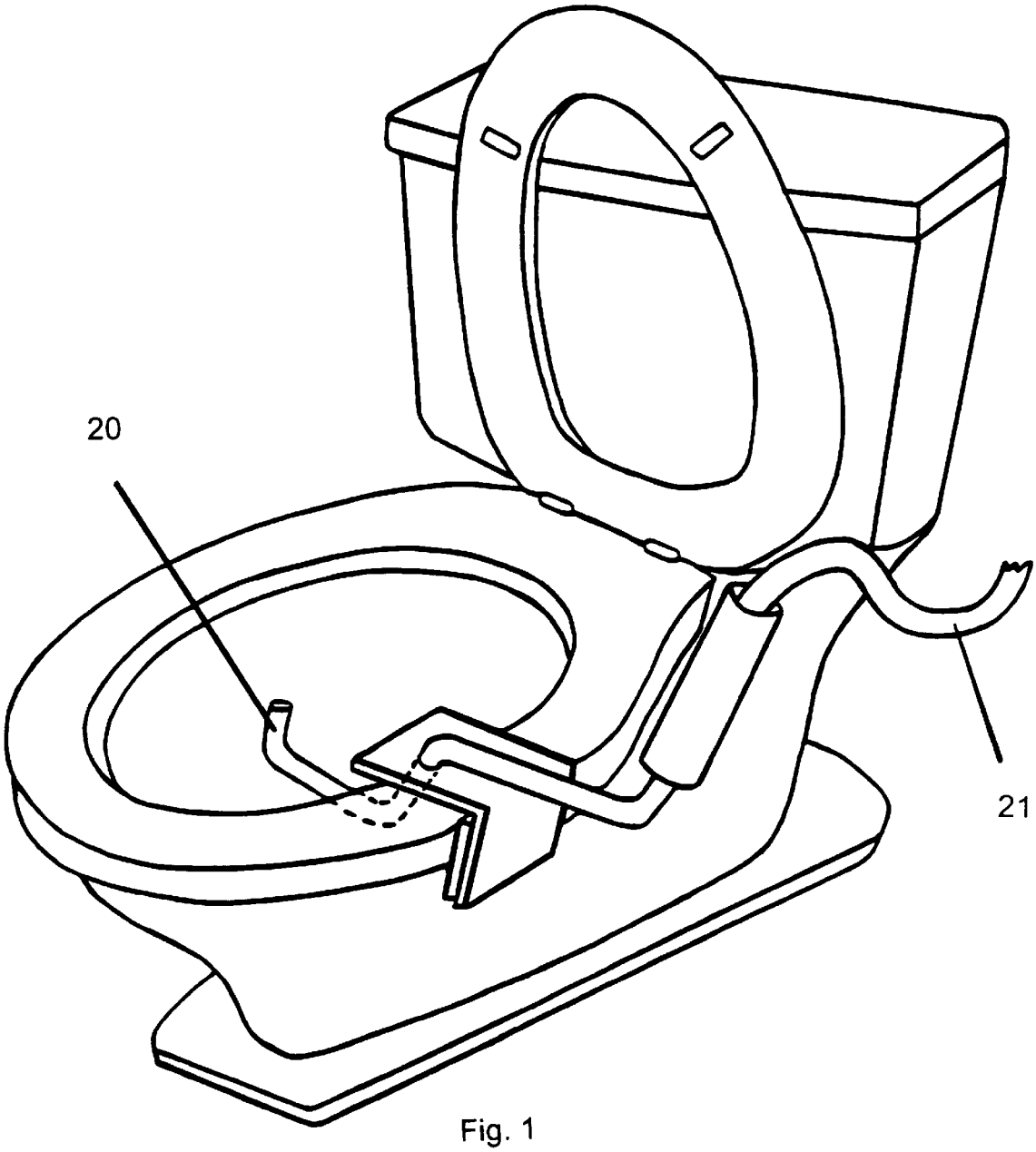
Fig. 1 ( Prior Art )

22 the bottle containing an anti-viral, anti-bacterial skin cleanser (shown in FIG. 1; upside down )

23 the soft bristles of the antiseptic brush

24 the rigid tubing of the antiseptic brush

25 the handle of the antiseptic brush

SUMMARY

The process of the use of the bidet and the antiseptic brush in combination enables the cleansing of the anal area of the buttocks and for dis-infection with the use of an anti-viral, anti-bacterial skin cleanser. The anal area of the buttocks has excessive perspiration and a higher body temperature; such an area enables bacteria and virus' to germinate and could lead to serious disease such as meningitis, hepatitis and many other diseases that may lead to loss of life. The elimination of bacteria and virus' from this area requires a special process of cleansing solid fecal matter with a forced stream of water and then dis-infection with use of an anti-viral, anti-bacterial, skin cleanser applied to the anal area with an antiseptic brush.

DESCRIPTION OF THE INVENTION

Figure 2:
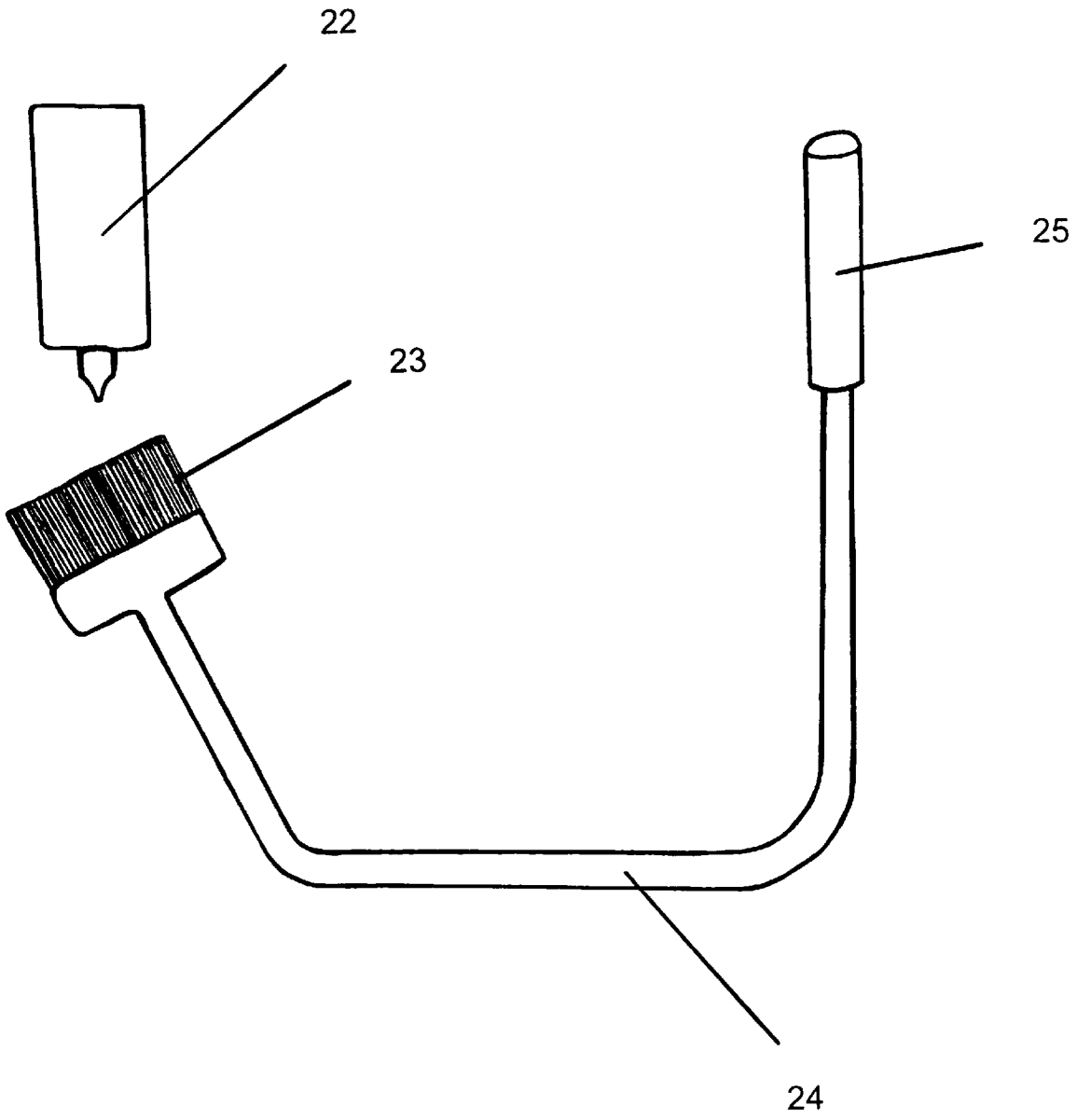
FIG. 2 shows the antiseptic brush and a bottle (shown upside down) which would contain an anti-bacterial, anti-viral, skin cleanser.
Figure 3:
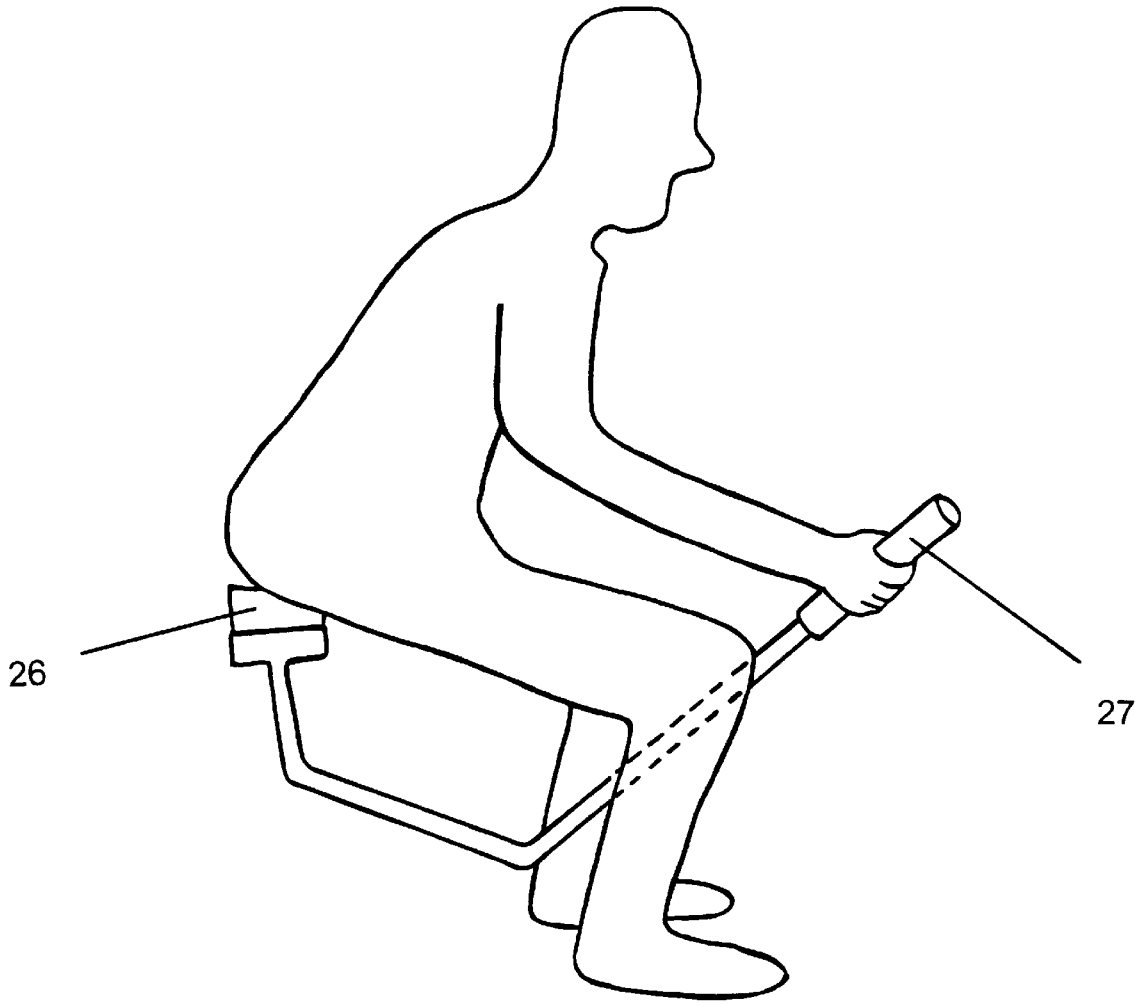
FIG. 3 shows a person in the process of using the antiseptic brush.

The process of the use of the bidet shown in the first page of the drawings (designated as: Prior Art ,) and then the use of the antiseptic brush shown in FIG. 2, in combination leads to cleansing and dis-infection. The Prior Art drawing shows the nozzle 20, of the bidet which directs a forced stream of water upward onto the dirty buttocks. The Prior Art drawing also shows the flexible tubing 21, that is attached to the water source. The Prior Art drawing is part of U.S. Pat. No. 5,722,097 issued on Mar. 3, 1998 to this inventor; William B. Deveer. FIG. 2 shows the antiseptic brush, which could be made of lightweight metal, plastic or other rigid tubing. It is formed with a handle 25, at the end of a vertical section of rigid tubing. This vertical section is at a 90 degree angle to a horizontal section of the antiseptic brush. The horizontal section, also made of rigid tubing, is in the middle of the antiseptic brush; with an angled rigid tubing section at the other end of the horizontal section. This angled section is approximately 60 degrees upward to the horizontal section. An upwardly facing brush with soft bristles 23, is affixed on top of the other end of the angled section. The brush is aligned on the same vertical plane as the structure of the antiseptic brush. FIG. 2 also shows the bottle 22 in an upside down position which would release the anti-bacterial, anti-viral skin cleanser onto the soft bristles 23, of the antiseptic brush. (The anti-viral, anti-bacterial, skin cleanser is used by surgeons for pre-operative dis-infection of the skin. It is also used for dis-infection of the hands by medical personnel. The manufacturers of such anti-septic skin cleansers include The Purdue Frederick Company in Norwalk, Conn. and The Barre Company in Baltimore Md.) FIG. 2 also shows the handle 25, which is used to grasp the antiseptic brush when used to disinfect the buttocks. FIG. 3 shows a person holding the brush by handle 25, with the soft bristles 23, of the antiseptic brush under the buttocks of the person.

OPERATION OF INVENTION

The process of the use of the bidet and the antiseptic brush, in combination, is required for for anti-sepsis of the anal area of the buttocks. The person would first use the bidet, such as the bidet shown in the Prior Art drawing, where the forced stream of water from nozzle 20, enables cleansing of the anal area of fecal matter. This prepares the area for anti-sepsis which is achieved by the application of an anti-viral, anti-bacterial, skin cleanser used with an antiseptic brush. FIG. 2 shows how the anti-septic skin cleanser is applied to the antiseptic brush from a plastic bottle 22, when held upside down and squeezed. FIG. 3 shows a person in the process of using the antiseptic brush. The person would spread their legs and prepare to lean forward and at the same time lower their buttocks and bend at their knees. This is similar to a person about to sit down on a chair. The person at this position would grasp the handle of the antiseptic brush and would apply a brushing motion forward and backward for scrubbing of the anal area of buttocks.

CONCLUSION, RAMIFICATIONS, AND SCOPE OF INVENTION

The process of the use of the bidet with the antiseptic brush in combination with an anti-viral, anti-bacterial skin cleanser leads to an anti-sepsis of the anal area of the buttocks. This could prevent serious diseases such as meningitis, hepatitis, and many other serious diseases that may lead to loss of life. The antiseptic brush can be used by children and adults. Children and the elderly are susceptible to such diseases due their age and stages of development.

While my above description contains many specificities, these should not be construed as limitations on the scope of the invention, but rather as an exemplification of one preferred embodiment thereof.

I claim:

1. A process of disinfecting the anal area of a user comprising:

the initial use of a bidet to clean fecal matter from the anal area of a user by forcing a stream of water onto the anal area, and the subsequent use of a brush to wash and disinfect the anal area of the user where in the brush includes a handle having a vertical section having a first end to be grasped by the user and a second end, a horizontal base section extending approximately 90 degrees from the vertical section and having a first end connected to the second end of the vertical section and a second end, an upwardly facing section extending approximately 60 degrees from the horizontal section and having a first end connected to the second end of the horizontal section and a second end and a brush having soft bristles thereon connected to the second end of the upwardly facing section.

2. The process of claim 1 further including:

applying an anti-viral, anti-bacterial skin cleanser which enables anti-sepsis of the anal area of the user to the brush before using the brush to wash and disinfect the anal area.

* * * * *